United States Patent [19]

Nagasaka et al.

[11] Patent Number: 4,941,839

[45] Date of Patent: Jul. 17, 1990

[54] DOUBLE LOCKING DEVICE FOR CONNECTOR

[75] Inventors: Yasuhiro Nagasaka; Tsuneo Shiga; Kazuyuki Shiraki, all of Toyota; Akira Maeda, Shizuoka; Shigemi Hashizawa, Shizuoka; Kazuto Ohtaka, Shizuoka, all of Japan

[73] Assignee: Yazaki Corporation, Tokyo, Japan

[21] Appl. No.: 411,151

[22] Filed: Sep. 22, 1989

Related U.S. Application Data

[63] Continuation-in-part of Ser. No. 358,119, May 30, 1989, abandoned.

[30] Foreign Application Priority Data

May 30, 1988 [JP] Japan ..... 63-70299
Sep. 27, 1988 [JP] Japan ..... 63-125093[U]

[51] Int. Cl.[5] ..... H01R 13/639

[52] U.S. Cl. ..... 439/352; 439/358; 439/489

[58] Field of Search ..... 439/350, 351, 352, 353, 439/354, 355, 356, 357, 358, 372, 347, 488, 489, 144, 586

[56] References Cited

U.S. PATENT DOCUMENTS

| | | | |
|---|---|---|---|
| 3,239,791 | 3/1966 | Fyrk | 439/44 |
| 4,376,563 | 3/1983 | Margrave et al. | 439/358 |
| 4,380,361 | 4/1983 | Asick et al. | 439/358 |
| 4,607,903 | 8/1986 | Hoshino et al. | 439/350 X |
| 4,623,210 | 11/1986 | Tsukakoshi | 439/358 |
| 4,674,814 | 6/1987 | Hoshino et al. | 439/586 |
| 4,708,413 | 11/1987 | Schroeder | 439/358 |
| 4,746,306 | 5/1988 | Yurtin et al. | 439/357 |

FOREIGN PATENT DOCUMENTS 3438137 4/1986 Fed. Rep. of Germany .

*Primary Examiner*—William Briggs

[57] ABSTRACT

A double locking device in a connector. Male and female connector housings are first engaged with each other to accomplish a first-step lock. Both housings further have auxiliary lock means therein: the female housing has a base plate pivotably mounted thereon, a cover plate perpendicularly formed to the base plate to cover the rear surface of the male housing when engaged with said female housing and a locking frame formed on said cover plate whereas the male housing has a catch pawl formed therein to receive the locking frame to accomplish a second-step lock.

7 Claims, 7 Drawing Sheets

DOUBLE LOCKING DEVICE FOR CONNECTOR

CROSS-REFERENCE TO RELATED PATENT APPLICATION

This patent application is a continuation-in-part of U.S. patent application Ser. No. 358,119 filed on May 30, 1989 abandoned.

BACKGROUND OF THE INVENTION

1. Field of the Invention

The present invention relates to a double locking device for a connector having an incomplete engagement detecting function for connecting wire harnesses in an air bag system or the like for an automobile.

2. Description of the Prior Art

In an air bag system or the like, incomplete engagement of a harness connector for connection of wire harnesses and/or incomplete contact between male and female terminals in the harness connector will cause defective operation of the air bag system or the like, which will directly endanger a human life.

There is disclosed in Japanese Utility Model Laid-Open Publication No. 60-220581 a harness connector intended to eliminate such incomplete engagement. The conventional harness connector is shown in FIGS. 8 and 9. Referring to the drawings, a male housing M is engaged into a female housing F. The female housing F is formed with a pivotable locking member b having a projection c. An upper surface f of the female housing F is formed with a hole a to be engaged with the projection c when the locking member b is pivoted in a direction as depicted by an arrow X. On the other hand, an upper surface m of the male housing M is also formed with a hole d to be aligned with the hole a of the female housing F when both the housings M and F are completely engaged with each other. Thus, the projection c of the locking member b can be engaged with both the holes a and d when the locking member b is pivoted to be closed as shown by a chain line in FIG. 9.

However, even when the male housing M is not engaged with the female housing F, the locking member b can be closed. Accordingly, there is a possibility that such disengagement of the male housing M will be unnoticed, resulting in disconnection of the mating materials.

SUMMARY OF THE INVENTION

It is an object of the present invention to provide a double locking device for a connector which may reliably prevent disengagement or incomplete engagement of the male and female housings.

It is another object of the present invention to provide a double locking device for a connector which may ensure stable electrical connection of the mating materials in the male and female housings.

According to the present invention, there is provided in a double locking device in a connector including a mating pair of a first housing and a second housing with respective terminals accommodated for electrical connection therein, said first and second housings being adapted for a first-step lock with each other, said double locking device comprising auxiliary lock means inlcuding first auxiliary locking means and second auxiliary locking means, said first auxiliary locking means being pivotably mounted on said first housing and normally biased to be erected on said first housing, said second auxiliary locking means being secured in said second housing, said first auxiliary locking means being adapted to be manually rotated against the bias to be brought into an engagement with the second locking member for a second-step lock of the connector when the first housing and the second housing have been completely engaged with each other for the first-step lock.

Other objects and features of the invention will be more fully understood from the following detailed description and appended claims when taken with the accompanying drawings.

DETAILED DESCRIPTION OF THE PREFERRED EMBODIMENTS

Figure 1:
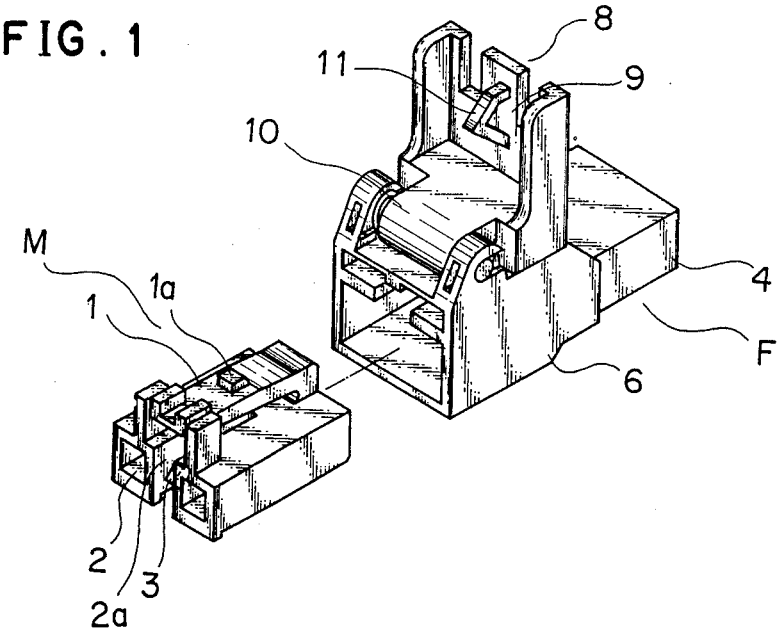
FIG. 1 is a perspective view of a connector in a disassembled condition showing a preferred embodiment of the present invention.
Figure 2:
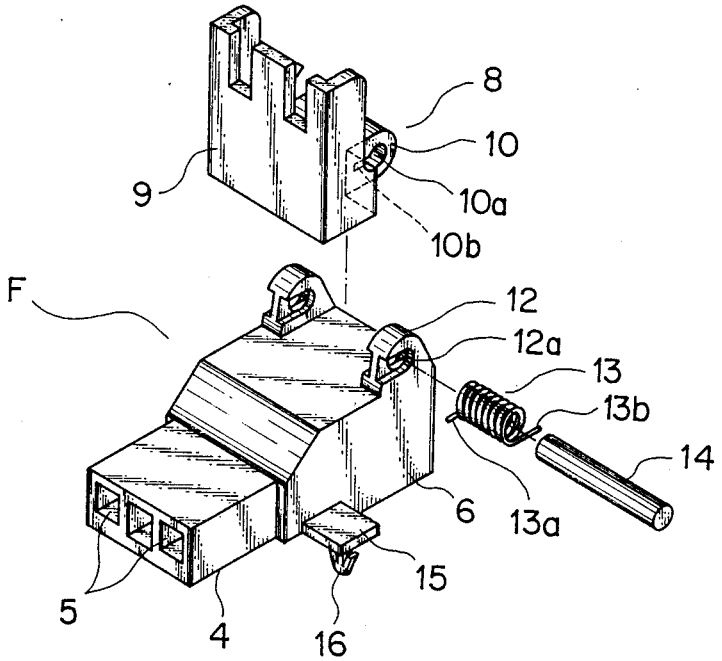
FIG. 2 is an exploeded perspective view of the assembly of the female housing and the locking member shown in FIG. 1.

Referring to FIGS. 1 and 2, reference character M designates a male housing formed at its upper surface with a lock arm 1 having a locking projection 1*a* for a first-step lock. The male housing M includes a pair of bifurcated chambers 2 for receiving terminals (not shown) therein with a recess 2*a* defined therebetween. A catchh pawl 3 is formed on one side wall surface of the recess 2*a* for engaging a locking frame 11 of a pivotable locking member 8 for a second-step lock which will be hereinafter described.

Figure 3A:
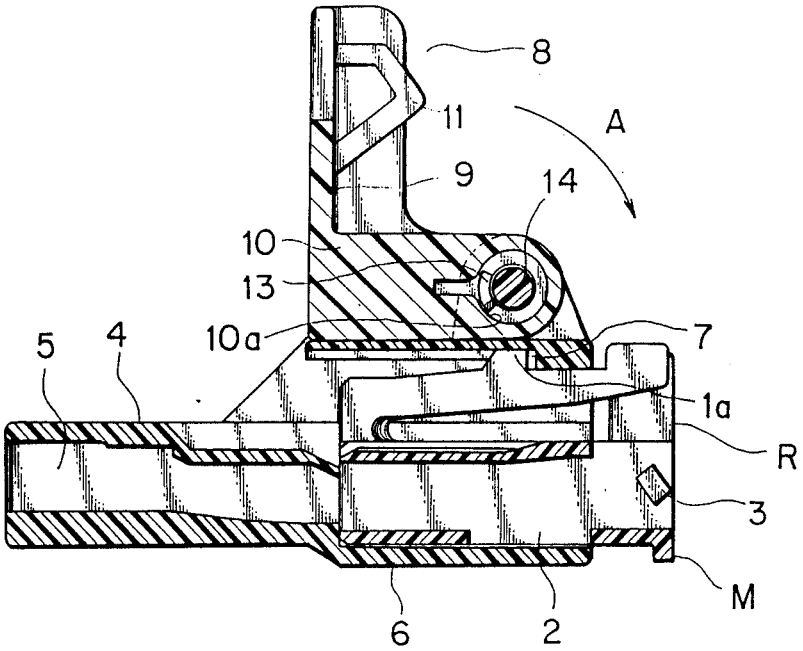
FIGS. 3A and 3B are sectional side views of the male and female housings completely engaged with each other under a normal condition and a locking condition of the locking member, respectively.
Figure 3B:
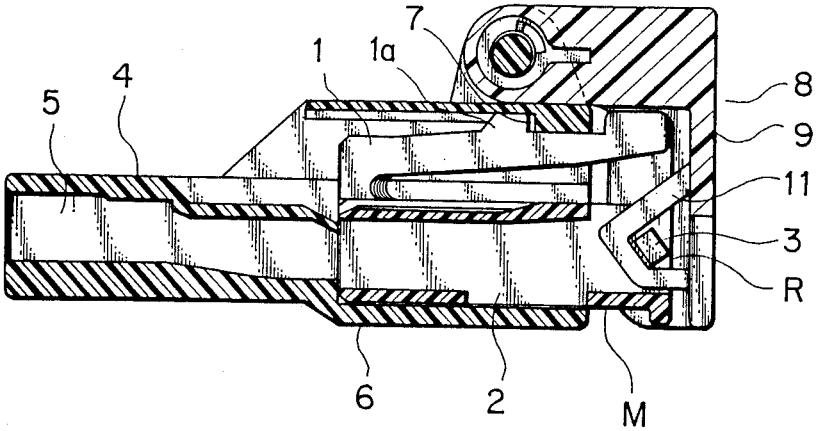

Reference character F designates a female housing constructed of a terminal receiving portion 4 defining therein a pair of terminal receiving chambers 5, a male housing receiving portion 6 for receiving the male housing M therein, and a locking member 8 pivotably mounted on the male housing receiving portion 6. As shown in FIGS. 3A and 3B, a channel 7 is formed on an inner surface of an upper wall of the male housing receiving portion 6 for engaging the locking projection 1*a* of the lock arm 1 of the male housing M. The channel 7 may be replaced by a slit.

The locking member 8 is generally formed in a sectional L-shape including a cover plate 9 and a base plate 10 perpendicular to the cover plate 9. As shown in FIG. 3A illustrating an unlocked condition of the locking member 8, the cover plate 9 is disposed to extend upwardly from the base plate 10. When both the housings M and F are locked by the locking member 8 as shown in FIG. 3B, the cover plate 9 is disposed in opposition to a rear surface R of the male housing M.

The cover plate 9 is formed on its inner surface with a locking frame 11 adapted to be engaged with the catch pawl 3 of the male housing M. The base plate 10 is formed at its end portion with a transversely extending through-hole 10*a* for inserting a pin 14 thereinto. The male housing receiving portion 6 is formed on its upper surface with a pair of bearing portions 12 having holes 12*a* for inserting the pin 14 therethrough. In assembling the locking member 8 with the male housing receiving portion 6, the base plate 10 is located between the pair of bearing portions 12 with the through-hole 10*a* aligned to the holes 12*a*. Then, a torsional coil spring 13 is interposed between one side surface of the base plate 10 and one of the bearing portions 12 with one end 13*a* of the torsional coil spring 13 engaged with a recess 10*b* of the base plate 10, while with the other end 13*b* engaged with the bearing portion 12. Then, the pin 14 is inserted from one of the holes 12*a* of the bearing portions 12 through the coil spring 13 and the through-hole 10*a* of the base plate 10 into the other hole 12*a* of the remaining bearing portion 12. Thus, the locking member 8 is pivotably mounted through the pin 14 to the male housing receiving portion 6. Under a normal condition of the locking member 8, the cover plate 9 is erected as shown in FIG. 3A by the torsional elastic force of the torsional coil spring 13.

The male housing receiving portion 6 of the female housing F is further formed at its lower end with a pair of mounting plates 15 projecting laterally in opposite directions. Each of the mounting plates 15 has a downwardly extending clip 16 adapted to be fixed to a fixed member such as a steering column for a vehicle.

As well known, each of the terminal receiving chambers 2 in the male housing M receives a female terminal, while each of the terminal receiving chambers 5 in the female housing F receives a male terminal. When both the housings M and F are completely engaged with each other, such female and male terminals are electrically connected with each other to form a plurality of terminal pairs. These terminal pairs are fixedly supported by flexible supporting arms.

Although the locking member 8 is mounted on the female housing F in the above preferred embodiment, it may be mounted on the male housing M. Further, the locking means formed by the locking frame 11 of the locking member 8 and the catch pawl 3 of the male housing M may be modified to any other locking mechanisms capable of ensuring reliable locking between the male and female housings.

In operation, the locking member 8 is normally conditioned in such that the cover plate 9 is maintained under an erected condition by the elastic force of the coil spring 13 as shown in FIG. 3A. The locking member 8 can be pivoted about the pin 14 in a direction of an arrow A. However, if the male housing M is not engaged or is incompletely engaged with the female housing F, the locking member 8 cannot be locked, that is, the locking frame 11 of the locking member 8 cannot be engaged with the catch pawl 3 of the male housing M. Accordingly, the disengagement or incomplete engagement of the male housing M with respect to the female housing F can be apparently confirmed by an operator form the erected condition of the cover plate 9.

As shown in FIG. 3B, when the male housing M is completely engaged with the female housing F, the locking projection 1*a* of the lock are 1 of the male housing M is engaged with the channel 7 of the female housing F. Thus, the first-step lock of both the housings M and F is accomplished. Under this locked condition, when the locking member 8 is pivoted about the pin 14 to the position where the cover plate 9 is brought into opposition to the rear surface R of the male housing M, the locking frame 11 of the locking member 8 is brought into engagment with the catch pawl 3 of the male housing M. Thus, the second-step lock of both the housings M and F is accomplished.

Figure 4:
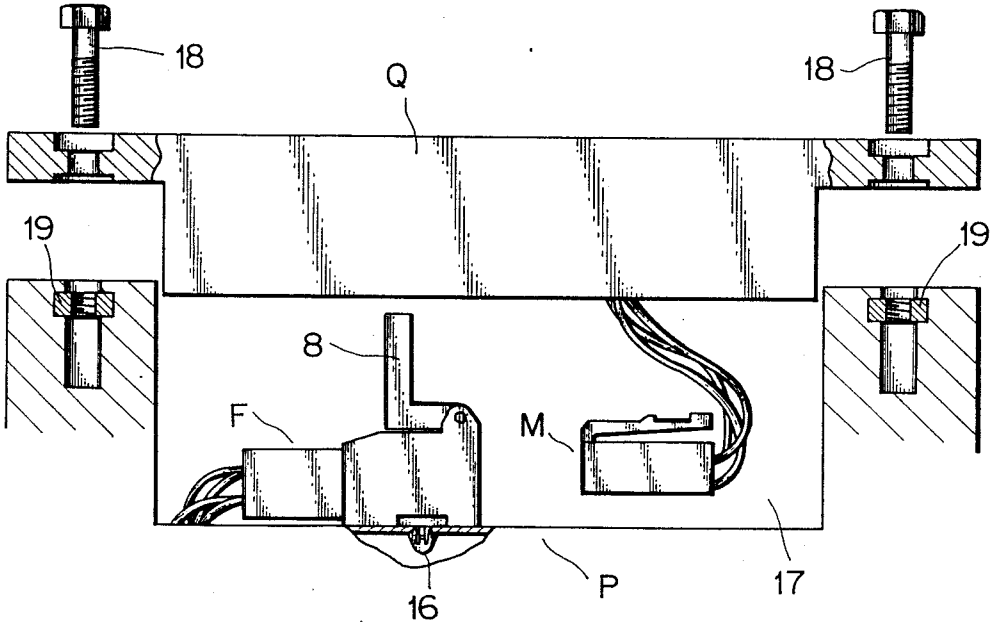
FIGS. 4 and 5 are side views in partly section of the connector of the present invention adapted to an air bag system under an unlocked condition and a locked condition, respectively.
Figure 5:
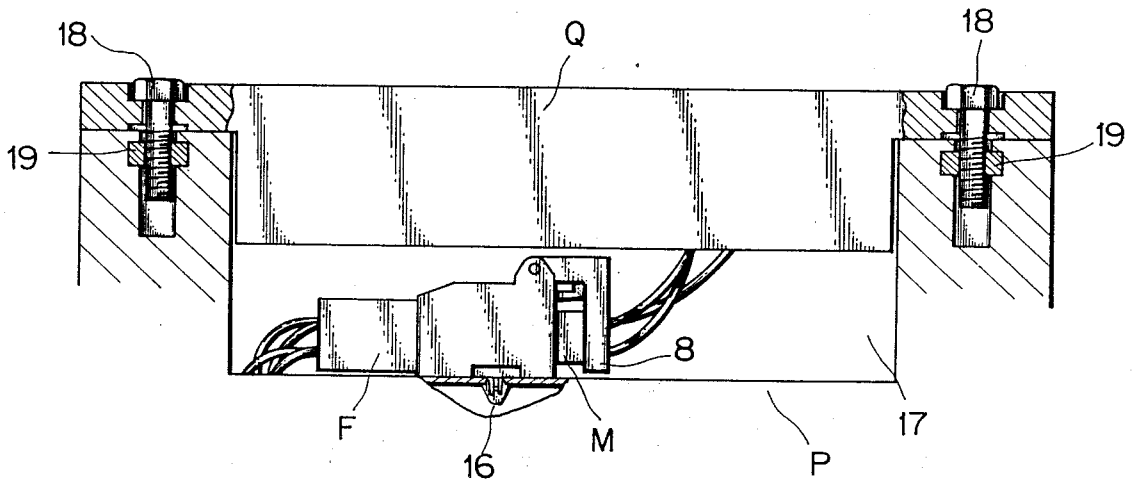

Referring to FIGS. 4 and 5 which show an exemplary adaptation of the harness connector according to the present invention, reference character P designates a fixed wall formed with a recess 17 on a steering shaft side of an automobile, and reference character Q designates an air bag system to be mounted to the fixed wall. The female housing F having the locking member 8 is fixed by the clips 16 to the bottom of the recess 17. On the other hand, the male housing M is connected through a wire harness to the air bag system Q.

When the male housing M is not engaged with the female housing F as shown in FIG. 4, the cover plate 9 of the locking member 8 is in the erected condition. Accordingly, the operator can apparently confirm the disengagement of the male housing M, and it is therefore possible to prevent that bolts 18 will be erroneously tightened to nuts 19 to fix the air bag system Q to the fixed wall in spite of the disengaged condition of the male housing M. Thus, it is possible to prevent the disengagement or incomplete engagement of the male housing M with respect to the female housing F.

When the locking member 8 is locked to the male housing M as shown in FIG. 5, it is ensured that the male housing M is completely engaged with the female housing F. Accordingly, the air bag system Q is allowed to be fixed to the fixed wall by tightening the bolts 18 to the nuts 19.

Figure 6:
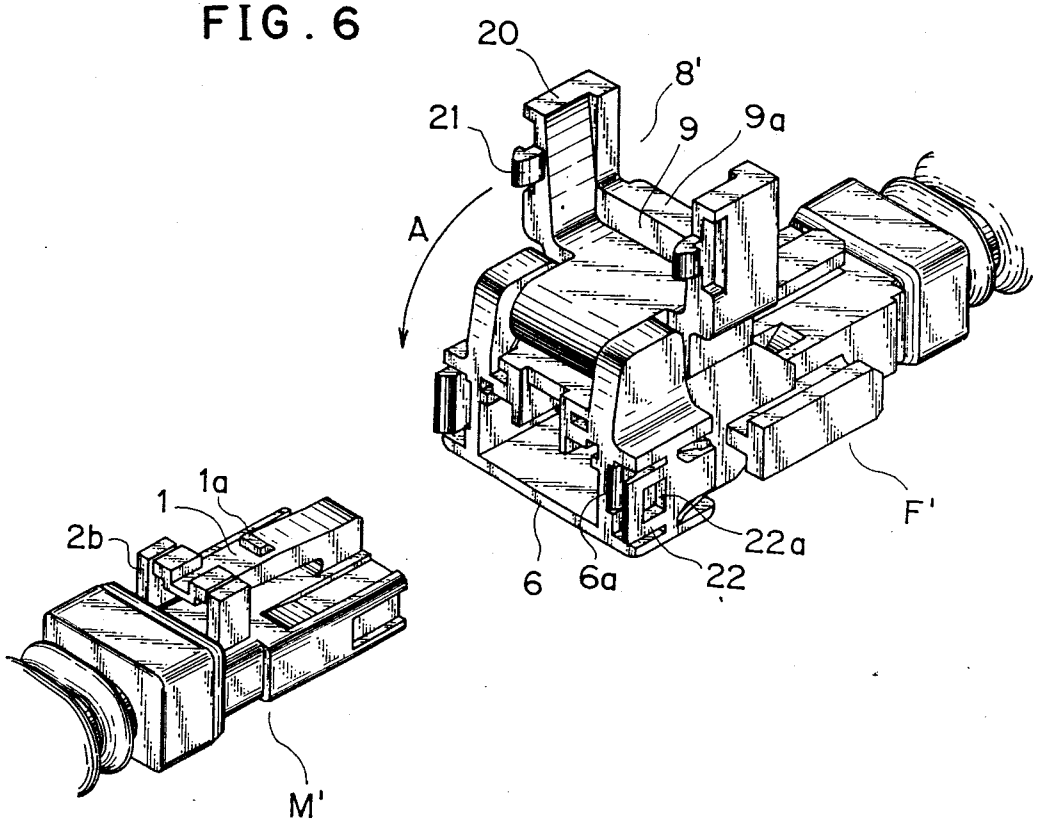
FIG. 6 is a perspective view of another connector in a disassembled condition showing another preferred embodiment of the present invention.

Referring now to FIG. 6, there is shown a double locking device for a connector according to a second preferred embodiment of the present invention. The double locking device shown has a substantially similar construction to that of the double locking device shown in FIGS. 1 to 3B, and like parts are denoted by like reference characters to those of FIGS. 1 to 3B and overlapping description thereof is omitted herein.

The double locking device shown in FIG. 6 is generally constructed such that a locking member 8' on a female housing F' can be locked to the female housing F' itself.

Figure 7A:
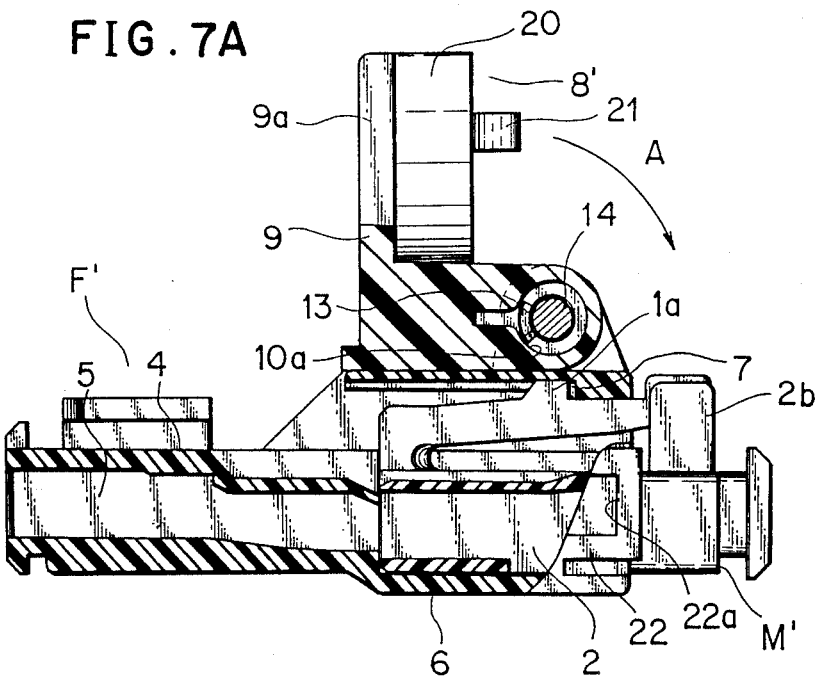
FIGS. 7A, 7B and 7C are sectional views showing the connector of FIG. 6 in different positions.
Figure 7B:
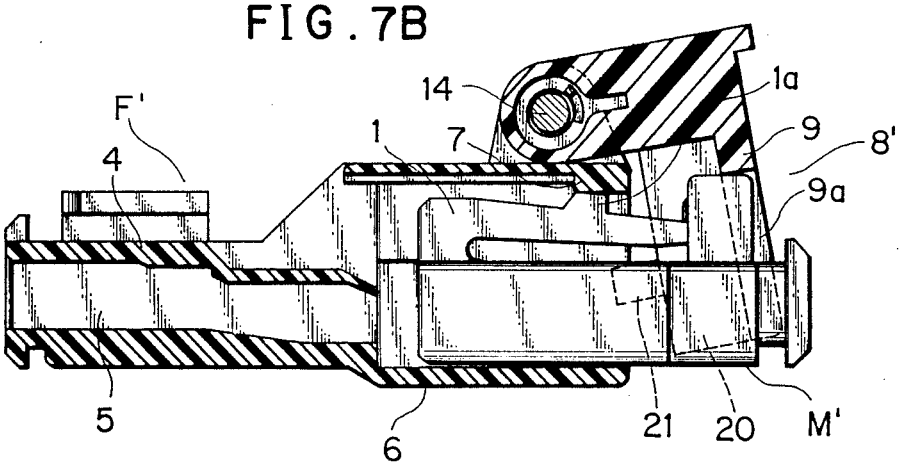

In particular, the locking member 8' is partially opened with a cutaway opening 9*a* formed in a cover plate 9 thereof, and a pair of catch pawls 21 are provided projectingly on a pair of side walls on the opposite sides of the cover plate 9. Meanwhile, a pair of flexible catch pieces 22 are provided on outer sides of the opposite side walls 6*a* of a male housing receiving portion 6 of the female housing F' and have catch holes 22*a* formed therein for engaging with the catch pieces 21 of the locking member 8'. It is to be noted that, similarly as in the double locking device of the first embodiment described hereinabove, the cover plate 9 of the locking member 8' is normally held at an uprightly erected position as shown in FIG. 7A under the urging force of a coil spring 13 fitted around a pin 14 serving as a shaft for the locking member 8' similarly as in the case of the embodiment shown in FIG. 1. Meanwhile, a male housing M' only has provided thereon a lock arm 1 having a locking projection 1*a* for engaging with a channel or catching member 7 of the female housing F' an a pair of arm guards 2*b* for preventing the lock arm 1 from being deformed inadvertently by an external force or from being damaged by interference with an electric wire, which are both provided on the male housing M in the first embodiment shown in FIGS. 1 to 3B. Or in other words, the recess 2*a* and the catch pawl 3 formed on the male housing M are omitted from the male housing M'.

The female housing F' of the present embodiment can be held, when not in use or not engaged with the male housing M', in a compact configuration if the locking member 8' is pivoted in the direction indicated by an arrow mark A in FIG. 7A until it is locked through engagement of the catch pieces 21 thereof with the catch holes 22*a* of the flexible catch pieces 22 of the female housing F'. Consequently, only a small spacing is required for accommodation of the female housing F', which is convenient for storage and transportation. Besides, in such an operation as to insert terminals with electric wires not shown into a terminal receiving chamber 5 of the female housing F', such a possible trouble is eliminated that the wires may be caught by the locking member 8' in an uprightly erected position by the coil spring 13.

To the contrary, when the female housing F' is to be used, if one of the flexible catch pieces 22 is widened or deformed laterally by an end of a screw driver or the like, then the locking member 8' is released from the female housing F'. Consequently, the locking member 8' is returned to its uprightly erected position by the coil spring 13 as shown in FIG. 6.

Figure 7C:
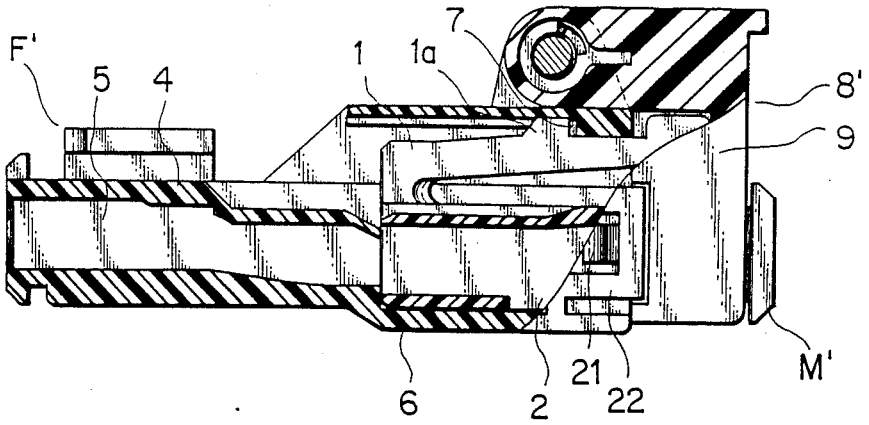
Figure 8:
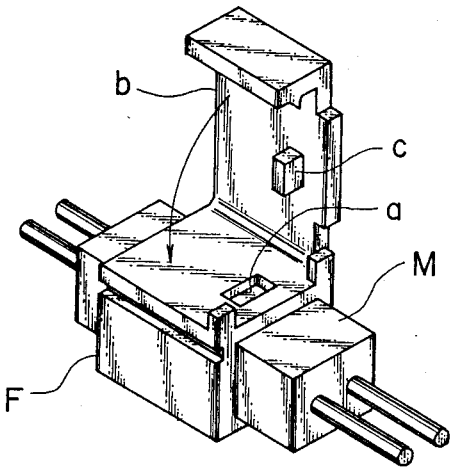
FIG. 8 PRIOR ART
FIGS. 8 and 9 are a perspective view and a sectional view of the connector in the prior art.
Figure 9:
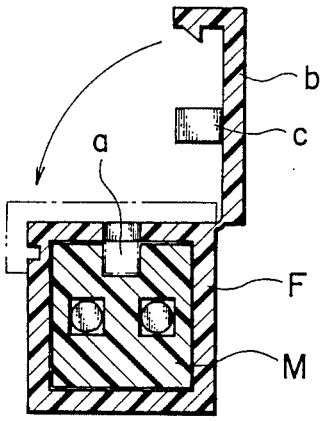
FIG. 9 PRIOR ART

Thus, if the male housing M' is fitted into the male housing receiving portion 6 of the female housing F' as shown in FIG. 7A and then the locking member 8' is pivoted in the closing direction as indicated by the arrow mark A, then the cover plate 9 of the locking member 8' is positioned behind the arm guards 2*b* of the male housing M' as shown in FIG. 7C and locked to the female housing F' due to engagement between the catch projections 21 and the catch holes 22*a*. Thus, the two housings F' and M' are locked to each other through double locks inlcuding a lock between the projection 1*a* of the lock arm 1 and the catch member or channel 7 and another lock between the catch projections 21 and the catch holes 22*a*.

If the engagement between the male and female housings M' and F' is incomplete, then the cover plate 9 of the locking member 8' will be contacted with the arm guards 2*b* of the male housing M' during manual pivotal motion of the locking member 8', and consequently, the locking member 8' cannot be pivoted to the fully pivoted locking position shown in FIG. 7C. Accordingly, possible incomplete engagement between the male and female housings M' and F' can be confirmed and hence prevented.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A double locking device in a connector including a mating pair of a first housing and a second housing with respective terminals accommodated for electrical connection therein, said first and second housings having a first-step locking means engageable with each other, said double locking device comprising:

auxiliary lock means including first auxiliary locking means and second auxiliary locking means, said first auxiliary locking means being pivotably mounted on said first housing and having means normally biasing said first auxiliary locking means to be erected on said first housing, said second auxiliary locking means being secured in said second housing, said first auxiliary locking means being adapted to be manually rotated against the biasing means to be brought into an engagement with the second locking member for a second-step lock of the connector when the first housing and the second housing have been completely engaged with each other for the first-step lock.

2. A double locking device according to claim 1, wherein said first housing includes a female housing whereas said second housing includes a male housing.

3. A double locking device according to claim 2, wherein said first auxiliary locking means inlcudes a base plate pivotably mounted on said female housing, a cover plate perpendicularly formed to said base plate to cover a rear surface of the male housing engaged with said female housing and a locking frame formed on said cover plate whereas said second auxiliary locking means includes a catch member formed in said male housing to receive said locking frame.

4. A double locking device in a connector including a mating pair of a first housing and a second housing with respective terminals accommodated for electrical connection therein, said first and second housings having a first-step locking means engageable with each other, said double locking device comprising:

auxiliary lock means inlcuding first auxiliary locking means and second auxiliary locking means, said first auxiliary locking means being pivotably mounted on said first housing and having means normally biasing said first auxiliary locking means to be erected on said first housing, said second auxiliary locking means being secured in said first housing, said first auxiliary locking menas being adapted to be manually rotated against the biasing means to be brought into an engagement with the first locking member for a second-step lock of the connector when the first housing and the second housingg have been completely engaged with each other for the first-step lock.

5. A double locking device according to claim 4, wherein said first housing includes a female housing whereas said second housing includes a male housing.

6. A double locking device according to claim 5, wherein said first auxiliary locking means includes a base plate pivotably mounted on said female housing, a cover plate perpendicularly formed to said base plate to cover a rear surface of the male housing engaged with said female housing and a locking element formed on said cover plate whereas said second auxiliary locking means includes a catch member formed in said female housing for engaging with said locking element.

7. A double locking device for a connector which includes a pair of first and second housings for mating engagement with each other, comprising automatically engageable locking means for automatically establishing a locked condition between said first and second housings when said first and second housings are brought into a fully engaged conditions, and auxiliary locking means for manually establishing a locked condition between said first and second housings, said auxiliary locking means including manually operable first auxiliary locking means supported for pivotal motion between an inoperative position and an operative position on said first housing, spring means for urging said first auxiliary locking means to be inoperative position in which said first auxiliary locking means extends outwardly from said first housing, and second auxiliary locking means provided on one of said first and second housings for cooperating with said first auxiliary locking meand to hold said first auxiliary locking means at the operative position in which said first auxiliary locking means prevents said second housing from being pulled off from said first housing.

* * * * *